US009172136B2

(12) United States Patent
Gavilan et al.

(10) Patent No.: US 9,172,136 B2
(45) Date of Patent: Oct. 27, 2015

(54) MULTI-BAND ANTENNA AND AN ELECTRONIC DEVICE INCLUDING THE SAME

(71) Applicant: Nvidia Corporation, Santa Clara, CA (US)

(72) Inventors: Joselito Gavilan, Santa Clara, CA (US); Warren Lee, Santa Clara, CA (US)

(73) Assignee: NVIDIA CORPORATION, Santa Clara, CA (US)

( * ) Notice: Subject to any disclaimer, the term of this patent is extended or adjusted under 35 U.S.C. 154(b) by 39 days.

(21) Appl. No.: 13/691,222

(22) Filed: Nov. 30, 2012

(65) Prior Publication Data

US 2014/0118194 A1 May 1, 2014

Related U.S. Application Data

(60) Provisional application No. 61/721,358, filed on Nov. 1, 2012.

(51) Int. Cl.

| | |
|---|---|
| ***H01Q 1/38*** | (2006.01) |
| ***H01Q 1/50*** | (2006.01) |
| ***H01Q 1/24*** | (2006.01) |
| ***H01Q 9/42*** | (2006.01) |
| ***H01Q 5/371*** | (2015.01) |
| ***H01Q 5/378*** | (2015.01) |

(52) U.S. Cl.

CPC ..... *H01Q 1/50* (2013.01); *H01Q 1/243* (2013.01); *H01Q 5/371* (2015.01); *H01Q 5/378* (2015.01); *H01Q 9/42* (2013.01)

(58) Field of Classification Search

USPC ..... 343/700 MS, 702, 866, 867

See application file for complete search history.

(56) References Cited

U.S. PATENT DOCUMENTS

| | | | | |
|---|---|---|---|---|
| 4,125,810 | A | 11/1978 | Pavio | |
| 6,229,487 | B1 * | 5/2001 | Sadler et al. | 343/700 MS |
| 6,476,769 | B1 * | 11/2002 | Lehtola | 343/702 |
| 6,911,940 | B2 | 6/2005 | Poilasne et al. | |
| 7,091,908 | B2 * | 8/2006 | Fabrega-Sanchez | 343/700 MS |
| 7,362,286 | B2 * | 4/2008 | Fang | 343/895 |
| 7,551,142 | B1 | 6/2009 | Zhang et al. | |
| 8,421,682 | B2 | 4/2013 | Nielsen et al. | |
| 8,779,999 | B2 | 7/2014 | Gummalla | |
| 2004/0252061 | A1 | 12/2004 | Vance | |
| 2008/0106478 | A1 | 5/2008 | Hill | |

(Continued)

OTHER PUBLICATIONS

Oh, Sung Hoon, et al., U.S. Appl. No. 14/159,880, filed Jan. 21, 2014, entitled "Wideband Antenna and An Electronic Device Including the Same".

Oh, Sung Hoon, et al., U.S. Appl. No. 14/160,036, filed Jan. 21, 2014, entitled "Wideband Loop Antenna and An Electronic Device Including the Same".

(Continued)

*Primary Examiner* — Tan Ho

(57) ABSTRACT

Provided is a multi-band antenna. The multi-band antenna, as provided in one embodiment, includes a first resonant portion having a first length defined by an outer perimeter of a conductive segment and operable to effect an antenna for communication in a first band of frequencies. The multi-band antenna, in this aspect, further includes a second resonant portion having a second length defined by an inner perimeter of the conductive segment and operable to resonate capacitively for communication in a second different band of frequencies.

20 Claims, 4 Drawing Sheets

(56) References Cited

U.S. PATENT DOCUMENTS

| | | | |
|---|---|---|---|
| 2010/0321255 | A1 | 12/2010 | Kough et al. |
| 2012/0154223 | A1 | 6/2012 | Oh et al. |
| 2012/0249393 | A1 | 10/2012 | Hotta et al. |
| 2013/0050057 | A1 | 2/2013 | Hayashi et al. |
| 2014/0118204 | A1 | 5/2014 | Gavilan et al. |
| 2015/0022402 | A1 | 1/2015 | Gavilan et al. |
| 2015/0022401 | A1 | 2/2015 | Gavilan et al. |

OTHER PUBLICATIONS

Oh, Sung Hoon, et al., U.S. Appl. No. 14/160,231, filed Jan. 21, 2014, entitled "Co-Located Antennas and An Electronic Device Including the Same".

Oh, Sung Hoon, et al., U.S. Appl. No. 14/160,277, filed Jan. 21, 2014, entitled "Single Element Dual-Feed Antennas and an Electronic Device Including the Same".

* cited by examiner

MULTI-BAND ANTENNA AND AN ELECTRONIC DEVICE INCLUDING THE SAME

CROSS-REFERENCE TO RELATED APPLICATION

This application claims the benefit of U.S. Provisional Application Ser. No. 61/721,358, filed by Joselito Gavilan, et al., on Nov. 1, 2012, entitled "Antennas Integrated with Metal Housings," commonly assigned with this application and incorporated herein by reference.

TECHNICAL FIELD

This application is directed, in general, to antennas and, more specifically, to multi-band antennas for handheld electronic devices.

BACKGROUND

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use long-range wireless communications to communicate with wireless base stations. For example, cellular telephones may communicate using 2G Global System for Mobile Communication (commonly referred to as GSM) frequency bands at about 850 MHz, 900 MHz, 1800 MHz, and 1900 MHz, among possible others. Communication is also possible in the 3G Universal Mobile Telecommunication System (commonly referred to as UMTS) and 4G Long Term Evolution (commonly referred to as LTE) frequency bands which range from 700 MHz to 3800 MHz. Furthermore, communication can operate on channels with variable bandwidths of 1.4 MHz to 20 MHz for LTE, as opposed to the fixed bandwidths of GSM (0.2 MHz) and UMTS (5 MHz). Handheld electronic devices may also use short-range wireless communications links. For example, handheld electronic devices may communicate using the Wi-Fi® (IEEE 802.11) bands at about 2.4 GHz and 5 GHz, and the Bluetooth® band at about 2.4 GHz. Handheld devices with Global Positioning System (GPS) capabilities receive GPS signals at about 1575 MHz.

To satisfy consumer demand for small form factor wireless devices, manufacturers are continually striving to reduce the size of components that are used in these devices. For example, manufacturers have made attempts to miniaturize the antennas used in handheld electronic devices. Unfortunately, doing so within the confines of the wireless device package is challenging.

Accordingly, what is needed in the art is an antenna, and associated wireless handheld electronic device that navigates the desires and problems associated with the foregoing.

SUMMARY

One aspect provides a multi-band antenna. The multi-band antenna, in this aspect, includes a first resonant portion having a first length defined by an outer perimeter of a conductive segment and operable to effect an antenna for communication in a first band of frequencies. The multi-band antenna, in this aspect, further includes a second resonant portion having a second length defined by an inner perimeter of the conductive segment and operable to resonate capacitively for communication in a second different band of frequencies.

Another aspect provides an electronic device. The electronic device, in this aspect, includes storage and processing circuitry, input-output devices associated with the storage and processing circuitry, and wireless communications circuitry including a multi-band antenna. The multi-band antenna, in this aspect, includes: 1) a first resonant portion having a first length defined by an outer perimeter of a conductive segment and operable to effect an antenna for communication in a first band of frequencies, and 2) a second resonant portion having a second length defined by an inner perimeter of the conductive segment and operable to resonate capacitively for communication in a second different band of frequencies.

BRIEF DESCRIPTION

Reference is now made to the following descriptions taken in conjunction with the accompanying drawings, in which.

DETAILED DESCRIPTION

Figure 1:
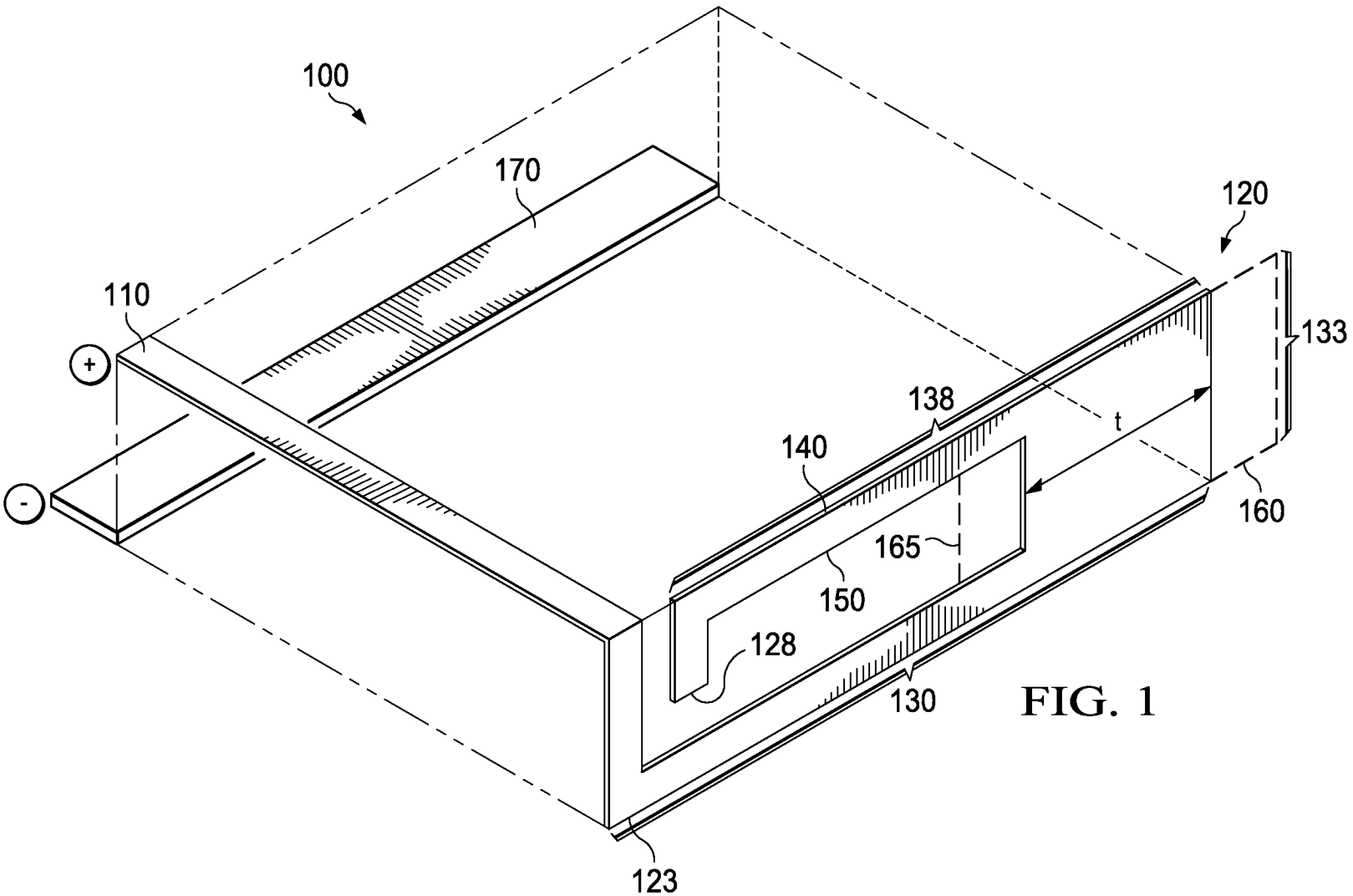
FIG. 1 illustrates aspects of a representative embodiment of a multi-band antenna in accordance with embodiments of the disclosure.

The present disclosure is based, at least in part, on the recognition that wireless networks are constantly evolving to increase speed and improve data communication, and that the latest cellular network, called Long Term Evolution (LTE) or 4G, not only operates in different frequency bands amongst carriers, but also between different regions. As a result, mobile electronic devices, such as smart phones, tablets and laptops, will need to support multiple LTE bands in addition to the legacy 3G (UMTS) and 2G (GSM) bands. The addition of these frequency bands creates a significant challenge for antenna designers, since the antennas will now need to cover additional bands in the same allocated volume.

With this recognition in mind, the present disclosure acknowledged, for the first time, that to reduce the volume of the antenna, multiple resonant frequencies may be created from a single segment by innovatively designing the geometry of the segment to induce multiple resonant modes. For example, by routing the segment in a shape of a partial loop and keeping the ends close but not touching, the segment may be designed to generate two resonant modes: (1) a resonant mode with frequency depending upon a length of the outer perimeter of the segment and (2) a resonant mode with frequency depending upon a length of the inner perimeter of the segment. Doing such, the present disclosure is capable of creating multiple resonances in the same antenna volume that currently exists today.

The present disclosure has further acknowledged that the two resonant modes will generate responses at two frequencies, which can be used to cover the required bands. Moreover, the present disclosure acknowledged that the frequency and bandwidth of these resonances can be tuned independently of one another, for example through various modifications to the geometry.

The present disclosure has yet further acknowledged that multiple segments, each including two resonant modes, can be coupled together to provide four or more resonant modes in the same antenna volume that currently exists today. Again, each of the four resonant modes, even though they are formed from only two segments, may be adjusted independently of the others.

The present disclosure has additionally acknowledged that a separate conductive segment can be positioned proximate the conductive segment having the two resonant modes, such that a capacitive coupling between the separate conductive segment and the conductive segment provides an effective length of the conductive segment greater than an actual length of the conductive segment. Thus, again within the same antenna volume that currently exists today, the actual length of the segment can be shorter while still achieving the desirable lower frequency bands. This technique can reduce the overall volume of the antenna.

By combining the innovative techniques of this disclosure, the industry would be able to cover multiple frequency bands while maintaining the same antenna volume, which is vital to creating smaller and/or thinner devices. Moreover, such a design would enable a single antenna design to support almost all of the GSM/UMTS/LTE bands, as defined by the 3$^{rd}$ Generation Partnership Project (3GPP).

FIG. 1 illustrates aspects of a representative embodiment of a multi-band antenna 100 in accordance with embodiments of the disclosure. The multi-band antenna 100 of FIG. 1 includes a feed portion 110. The feed portion 110, in this embodiment, may be that portion of the multi-band antenna 100 that first receives radio frequency signals from one or more associated transceivers in a related electronic device. For example, the feed portion 110 might directly couple to a positive terminal of a transmission line (not shown), such as a coaxial cable, microstrip, etc., to receive radio frequency signals from associated transceivers, and provide them to the other portions of the multi-band antenna 100. The feed portion 110 may additionally receive radio frequency signals from the other portions of the multi-band antenna 100, and thus provide them to the associated transceivers.

Coupled to the feed portion 110 in the embodiment of FIG. 1 is a conductive segment 120. The term "conductive segment", as used herein, requires that the two ends of the conductor not close back upon themselves to form a closed loop. A closed loop, as well as a slot in a conductor, are not considered conductive segments as that term is defined herein. The conductive segment 120, in the illustrated embodiment, includes a first end 123 and a second end 128, and is formed as a partial loop. Further to the illustrative embodiment of FIG. 1, the conductive segment 120 folds back upon itself to form the partial loop. For instance, in the embodiment shown, the conductive element includes a first section 130, a second section 133 coupled to the first section 130, and a third section 138 coupled to the second section 133. In this embodiment, the second section 133 is shorter than, and substantially perpendicular to, the first section 130. Additionally, the third section 138 doubles back upon, and is substantially parallel to, the first section 130. This is but one embodiment of a configuration for the conductive segment 120. In another embodiment, the conductive segment 120 might take a more circular shape.

The multi-band antenna 100 illustrated in FIG. 1, as a result of the unique design thereof, includes a first resonant portion 140 and a second resonant portion 150. The term "resonant portion", as used herein, is intended to mean a portion of the antenna geometry that resonates at a desired band of frequencies. The first resonant portion 140, in the illustrative embodiment, includes a first length defined by an outer perimeter of the conductive segment 120. The first length, in the embodiment of FIG. 1, is defined by an outer perimeter of the first section 130, second section 133 and third section 138. The first resonant portion 140, in accordance with the disclosure, is operable to effect an antenna for communication in first band of frequencies.

The second resonant portion 150, in the illustrative embodiment, includes a second different length defined by an inner perimeter of the conductive segment 120. The second different length, in the embodiment of FIG. 1, is defined by an inner perimeter of the first section 130, second section 133 and third section 138. The second resonant portion 150, as a result of the geometry of the inner loop, includes a capacitive resonance. The term "capacitive resonance", as used herein, is intended to mean the resonance at a desired band of frequencies due to two conductors being capacitively coupled to one another. Accordingly, the second resonant portion 150 is operable to resonate capacitively for communication in a second different band of frequencies.

Unique to the present disclosure, the band of frequencies that the first and second resonant portions 140, 150 may operate are independently adjustable. For example, the first length and second different length may be modified independent of one another. In the illustrate embodiment, this may be achieved by changing a thickness (t) of at least a portion of the conductive segment 120. For example, if the thickness (t) of the conductive segment is increased, for example to the dotted line 160, the first length would be increased without changing the second different length. Alternatively, if the thickness (t) of the conductive segment is increased, for example to the dotted line 165, the second different length would be decreased without changing the first length. Modifications to the thickness (t) of the first and third sections 130, 138, like the second section 133, may also modify the first and second lengths independent of one another. Therefore, modifications in the geometry of the conductive segment 120 can be used to independently tune the first and second resonant portions 140, 150.

The first and second resonant portions 140, 150, in the illustrated embodiment, are substantially planar portions. Accordingly, in the embodiment, of FIG. 1, the first and second resonant portions 140, 150 are formed in a same plane. In one embodiment the plane that the first and second resonant portions 140, 150 are located is coplanar with a plane defined by an edge of the electronic device the multi-band antenna 100 might be employed. In an alternative embodiment, the plane that the first and second resonant portions 140, 150 are located are coplanar with a plane defined by a display of the electronic device the multi-band antenna 100 might be employed. Other embodiments may exist wherein the first and second portions 140, 150 are not formed in a same plane.

The multi-band antenna 100 illustrated in the embodiment of FIG. 1 additionally includes a ground (e.g., ground plane) portion 170. In the illustrated embodiment, ground portion 170 might directly couple to a negative terminal of the transmission line (not shown), such as a coaxial cable, microstrip, etc.

Figure 2:
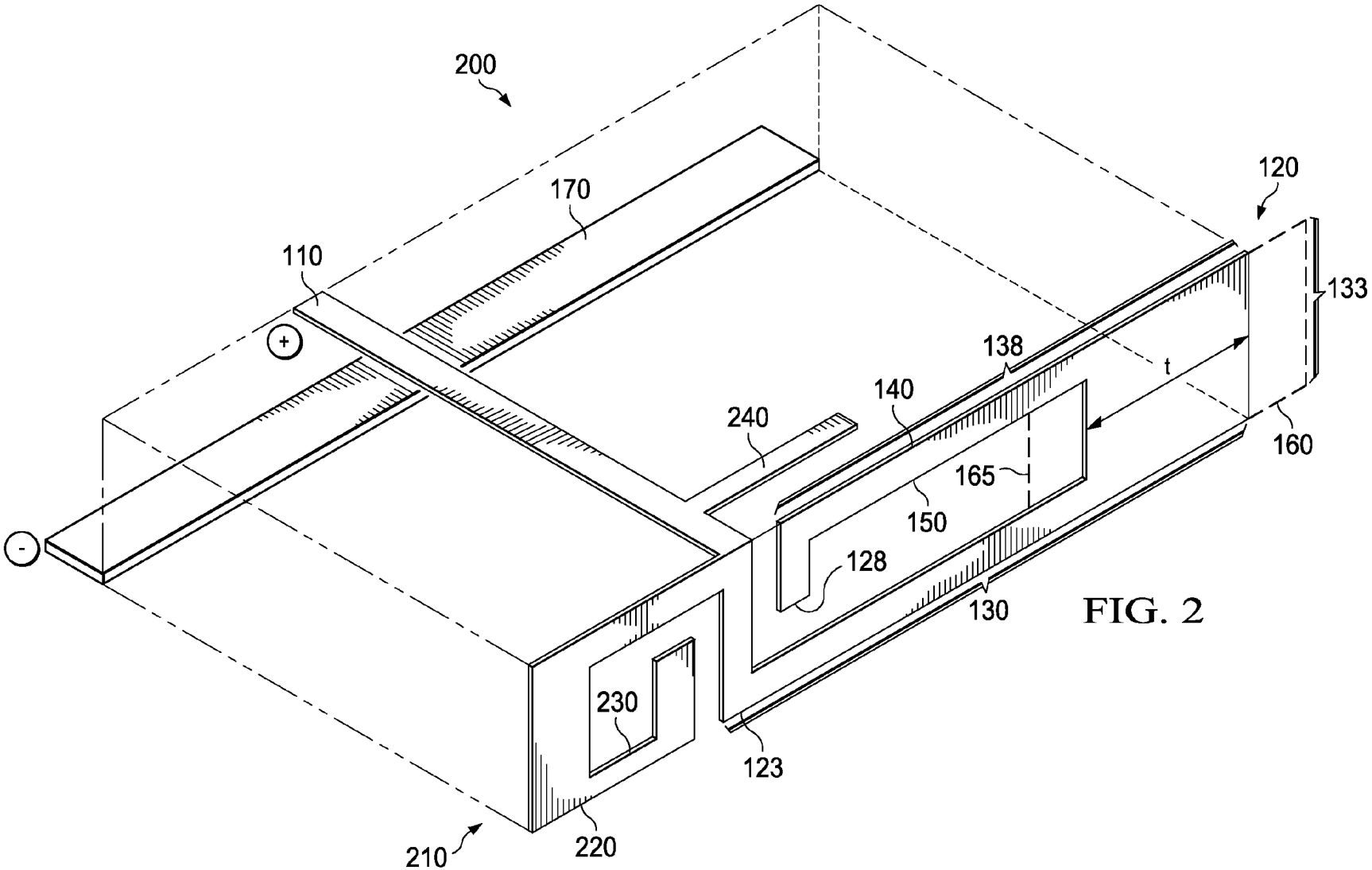
FIG. 2 illustrates alternative aspects of a representative embodiment of a multi-band antenna in accordance with embodiments of the disclosure.

FIG. 2 illustrates alternative aspects of a representative embodiment of a multi-band antenna 200 in accordance with embodiments of the disclosure. Where used, like reference numerals indicate similar features. In addition to the features of FIG. 1, the multi-band antenna 200 includes a second conductive segment 210 coupled to the feed portion 110. In this embodiment, the second conductive segment 210 includes a third resonant portion 220 having a third length defined by an outer perimeter of the second conductive segment 210, and a fourth resonant portion 230 having a fourth length defined by an inner perimeter of the second conductive segment 210. While the second conductive segment 210 (and first conductive segment 120 for that matter) is illustrated as a counter-clockwise partial loop, those skilled in the art understand that it could just as easily been configured as a clockwise partial loop and remain within the scope of the present disclosure. Accordingly, the third resonant portion 220 is operable to effect an antenna for communication in a third band of frequencies, and the fourth resonant portion 230 is operable to resonate capacitively for communication in a fourth different band of frequencies. In the illustrated embodiment, the first, second, third and fourth lengths are different, thus the first, second, third and fourth bands of frequencies are different. Again, however, the multi-band antenna 200 of FIG. 1 is achieving four different bands of frequencies in a space that might traditionally only achieve one or two different bands of frequencies.

The multi-band antenna 200 of FIG. 2 further includes a separate conductive segment 240. The separate conductive segment 240 is additionally coupled to the feed portion 110. In the illustrated embodiment, the separate conductive segment 240 operates in a single band of frequencies, for example a fifth band of frequencies. Moreover, unique to the present disclosure, in the embodiment of FIG. 1 the separate conductive segment 240 may be positioned proximate the conductive segment 120, such that a capacitive coupling between the separate conductive segment 240 and the conductive segment 120 exists. Moreover, the capacitive coupling may be tailored, such that an effective length of the conductive segment 120 (as opposed to the actual length) increases without physically increasing the physical length of the conductive segment 120. Accordingly, the actual first length of the conductive segment 120 can be shorter while still covering the lower frequency bands. Again, this technique can reduce the overall volume of the multi-band antenna 200.

Figure 3:
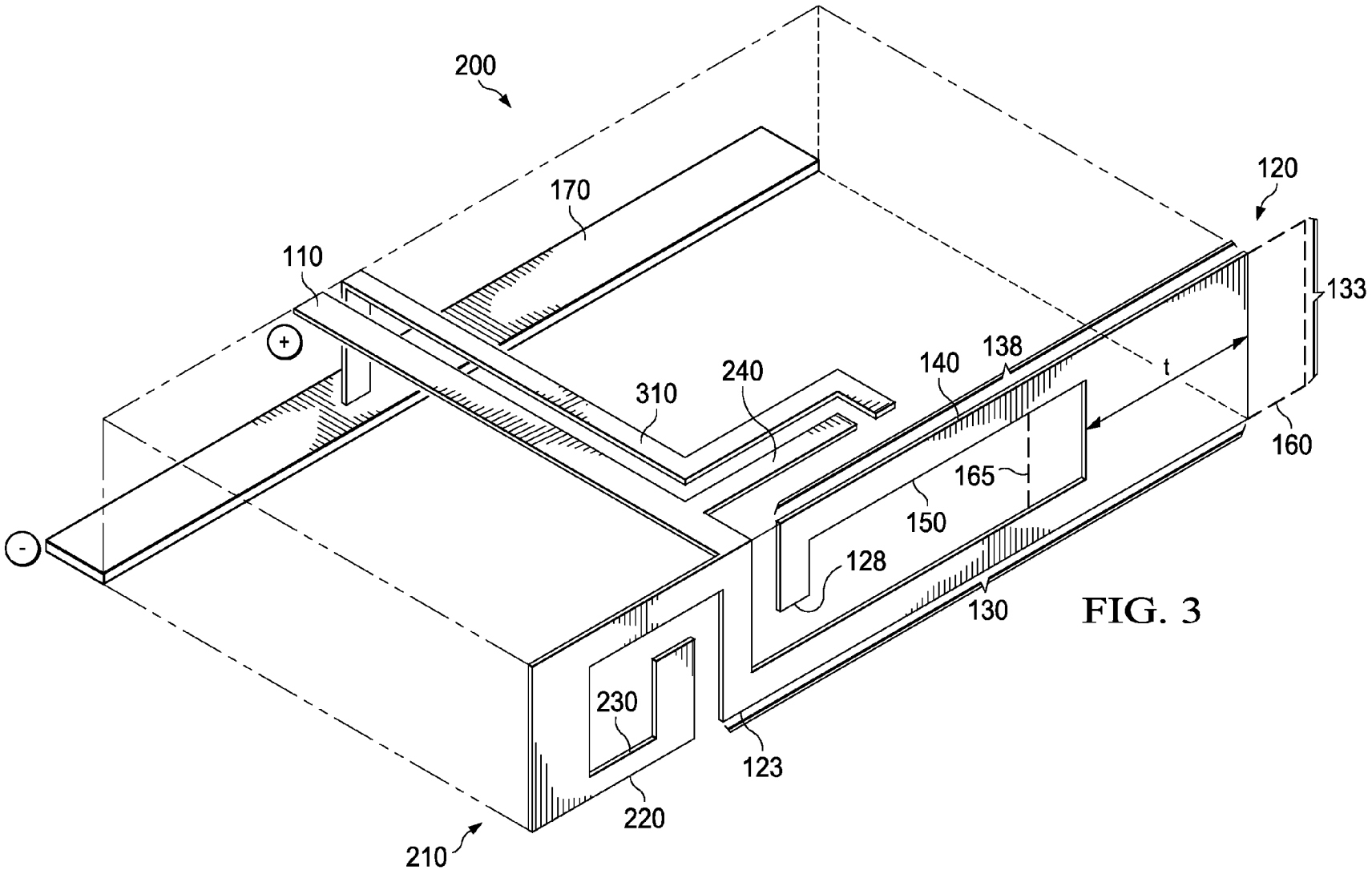
FIG. 3 illustrates alternative aspects of a representative embodiment of a multi-band antenna in accordance with embodiments of the disclosure.

FIG. 3 illustrates alternative aspects of a representative embodiment of a multi-band antenna 300 in accordance with embodiments of the disclosure. Again, where used, like reference numerals indicate similar features. In addition to the features of FIG. 2, the multi-band antenna 300 includes a parasitic arm 310. The parasitic arm 310, in accordance with the disclosure, may be used to lower the frequency and increase the bandwidth of the separate conductive segment 240. Those skilled in the art, given the present disclosure, would understand the steps required to employ a parasitic arm, such as the parasitic arm 310.

Figure 4:
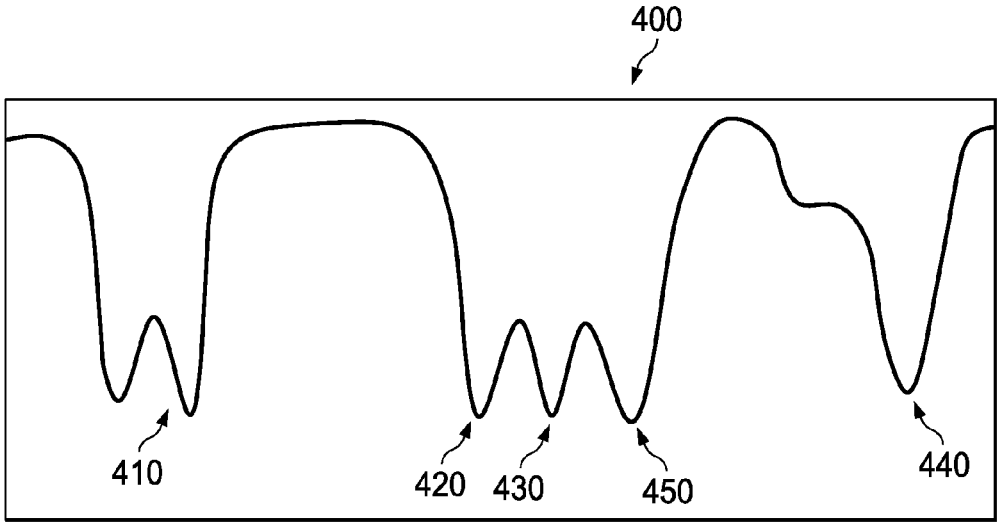
FIG. 4 illustrates an S-parameter plot for a multi-band antenna in accordance with the present disclosure.

FIG. 4 illustrates an S-parameter plot 400 for a multi-band antenna in accordance with the present disclosure. The S-parameter plot 400 might, in one embodiment, be representative of the multi-band antenna 300 of FIG. 3. In the illustrative embodiment, the first resonant portion 140 and second resonant portion 150 of the first conductive segment 120 might be found at positions, 410, 420, respectively, the third resonant portion 220 and fourth resonant portion 230 of the second conductive segment 210 might be found at about positions 430, 440, respectively, and the separate conductive segment 240 might be found at about position 450. Obviously, this is but one configuration for a multi-band antenna. Accordingly, those skilled in the art appreciate that the geometries of the individual portions of the multi-band antenna may be modified, thereby changing the positions upon the plot 400.

Figure 5:
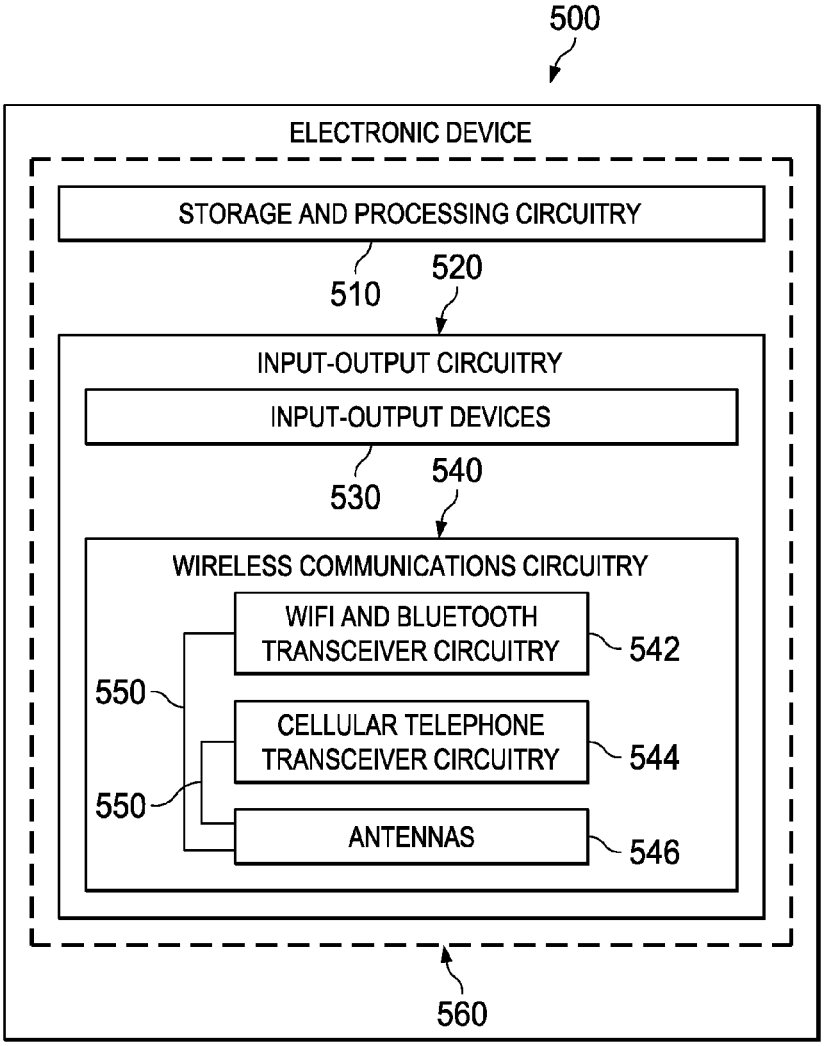
FIG. 5 illustrates aspects of a representative embodiment of electronic device in accordance with embodiments of the disclosure.

FIG. 5 shows a schematic diagram of electronic device 500. Electronic device 500 may be a portable device such as a mobile telephone, a mobile telephone with media player capabilities, a handheld computer, a remote control, a game player, a global positioning system (GPS) device, a laptop computer, a tablet computer, an ultraportable computer, a combination of such devices, or any other suitable portable electronic device.

As shown in FIG. 5, electronic device 500 may include storage and processing circuitry 510. Storage and processing circuitry 510 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 510 may be used to control the operation of device 500. Processing circuitry may be based on a processor such as a microprocessor and other suitable integrated circuits. With one suitable arrangement, storage and processing circuitry 510 may be used to run software on device 500, such as internet browsing applications, voice-over-internet-protocol (VOIP) telephone call applications, email applications, media playback applications, operating system functions, etc. Storage and processing circuitry 510 may be used in implementing suitable communications protocols.

Communications protocols that may be implemented using storage and processing circuitry 510 include, without limitation, internet protocols, wireless local area network protocols (e.g., IEEE 802.11 protocols—sometimes referred to as WiFi®), protocols for other short-range wireless communications links such as the Bluetooth® protocol, protocols for handling 3 G communications services (e.g., using wide band code division multiple access techniques), 2G cellular telephone communications protocols, etc. Storage and processing circuitry 510 may implement protocols to communicate using 2G cellular telephone bands at 850 MHz, 900 MHz, 1800 MHz, and 1900 MHz (e.g., the main Global System for Mobile Communications or GSM cellular telephone bands) and may implement protocols for handling 3G and 4 G communications services.

Input-output device circuitry 520 may be used to allow data to be supplied to device 500 and to allow data to be provided from device 500 to external devices. Input-output devices 530 such as touch screens and other user input interfaces are examples of input-output circuitry 520. Input-output devices 530 may also include user input-output devices such as buttons, joysticks, click wheels, scrolling wheels, touch pads, key pads, keyboards, microphones, cameras, etc. A user can control the operation of device 500 by supplying commands through such user input devices. Display and audio devices may be included in devices 530 such as liquid-crystal display (LCD) screens, light-emitting diodes (LEDs), organic light-emitting diodes (OLEDs), and other components that present visual information and status data. Display and audio components in input-output devices 530 may also include audio equipment such as speakers and other devices for creating sound. If desired, input-output devices 530 may contain audio-video interface equipment such as jacks and other connectors for external headphones and monitors.

Wireless communications circuitry 540 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications). Wireless communications circuitry 540 may include radio-frequency transceiver circuits for handling multiple radio-frequency communications bands. For example, circuitry 540 may include transceiver circuitry 542 that handles 2.4 GHz and 5 GHz bands for WiFi® (IEEE 802.11) communications and the 2.4 GHz Bluetooth® communications band. Circuitry 540 may also include cellular telephone transceiver circuitry 544 for handling wireless communications in cellular telephone bands such as the GSM bands at 850 MHz, 900 MHz, 1800 MHz, and 1900 MHz, as well as the UMTS and LTE bands (as examples). Wireless communications circuitry 540 can include circuitry for other short-range and long-range wireless links if desired. For example, wireless communications circuitry 540 may include global positioning system (GPS) receiver equipment, wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 540 may include antennas 546. Device 500 may be provided with any suitable number of antennas. There may be, for example, one antenna, two antennas, three antennas, or more than three antennas, in device 500. At least one of the antennas 546 in the device 500, in one embodiment, is similar to the antennas illustrated and described with regard to FIGS. 2-3 above. In accordance with that discussed above, the antennas may handle communications over multiple communications bands. If desired, a dual band antenna may be used to cover two bands (e.g., 2.4 GHz and 5 GHz). Different types of antennas may be used for different bands and combinations of bands. For example, it may be desirable to form a multi-band antenna for forming a local wireless link antenna, a multi-band antenna for handling cellular telephone communications bands, and a single band antenna for forming a global positioning system antenna (as examples).

Paths 550, such as transmission line paths, may be used to convey radio-frequency signals between transceivers 542 and 544, and antennas 546. Radio-frequency transceivers such as radio-frequency transceivers 542 and 544 may be implemented using one or more integrated circuits and associated components (e.g., power amplifiers, switching circuits, matching network components such as discrete inductors, capacitors, and resistors, and integrated circuit filter networks, etc.). These devices may be mounted on any suitable mounting structures. With one suitable arrangement, transceiver integrated circuits may be mounted on a printed circuit board. Paths 550 may be used to interconnect the transceiver integrated circuits and other components on the printed circuit board with antenna structures in device 500. Paths 550 may include any suitable conductive pathways over which radio-frequency signals may be conveyed including transmission line path structures such as coaxial cables, microstrip transmission lines, etc.

The device 500 of FIG. 5 further includes a chassis 560. The chassis 500 may be used for mounting/supporting electronic components such as a battery, printed circuit boards containing integrated circuits and other electrical devices, etc. For example, in one embodiment, the chassis 560 positions and supports the storage and processing circuitry 510, and the input-output circuitry 520, including the input-output devices 530 and the wireless communications circuitry 540 (e.g., including the WIFI and Bluetooth transceiver circuitry 542, the cellular telephone circuitry 544, and the antennas 546.

The chassis 560, in one embodiment, is a metal chassis. For example, the chassis 560 may be made of various different metals, such as aluminum. Chassis 560 may be machined or cast out of a single piece of material, such as aluminum. Other methods, however, may additionally be used to form the chassis 560.

Those skilled in the art to which this application relates will appreciate that other and further additions, deletions, substitutions and modifications may be made to the described embodiments.

What is claimed is:

1. A multi-band antenna, comprising:

a first resonant portion having a first length defined by an outer perimeter of a conductive segment and operable to effect an antenna for communication in a first band of frequencies; and a second resonant portion having a second length defined by an inner perimeter of the conductive segment and operable to resonate capacitively for communication in a second different band of frequencies.

2. The multi-band antenna of claim 1, wherein the first resonant portion and the second resonant portion are substantially planar portions.

3. The multi-band antenna of claim 1, wherein the conductive segment is formed as a partial loop.

4. The multi-band antenna of claim 3, wherein the conductive segment folds back upon itself to form the partial loop.

5. The multi-band antenna of claim 4, wherein the conductive segment includes a first section, a second section coupled to and shorter than the first section, and a third section coupled to the second section and doubling back on the first section.

6. The multi-band antenna of claim 5, wherein the first section and second section are substantially perpendicular to one another, and the first section and third section are substantially parallel to one another.

7. The multi-band antenna of claim 1, wherein one of the first length or the second length may be modified without modifying the other of the second length or the first length.

8. The multi-band antenna of claim 7, wherein a thickness of at least a portion of the conductive segment is adjusted to modify the one of the first length or the second length without modifying the other of the second length or the first length.

9. The multi-band antenna of claim 1, wherein the conductive segment is a first conductive segment, and further including a second conductive segment, wherein the second conductive segment includes:

a third resonant portion having a third length defined by an outer perimeter of the second conductive segment and operable to effect an antenna for communication in a third band of frequencies; and a fourth resonant portion having a fourth length defined by an inner perimeter of the second conductive segment and operable to resonate capacitively for communication in a fourth different band of frequencies.

10. The multi-band antenna of claim 1, further including a separate conductive segment, the separate conductive segment positioned proximate the conductive segment, such that a capacitive coupling between the separate conductive segment and the conductive segment provides an effective length of the conductive segment greater than an actual length of the conductive segment.

11. An electronic device, comprising:

storage and processing circuitry;

input-output devices associated with the storage and processing circuitry; and wireless communications circuitry including a multi-band antenna, the multi-band antenna including;

a first resonant portion having a first length defined by an outer perimeter of a conductive segment and operable to effect an antenna for communication in a first band of frequencies; and a second resonant portion having a second length defined by an inner perimeter of the conductive segment and operable to resonate capacitively for communication in a second different band of frequencies.

12. The electronic device of claim 11, wherein the first resonant portion and the second resonant portion are substantially planar portions.

13. The electronic device of claim 11, wherein the conductive segment is formed as a partial loop.

14. The electronic device of claim 13, wherein the conductive segment folds back upon itself to form the partial loop.

15. The electronic device of claim 14, wherein the conductive segment includes a first section, a second section coupled to and shorter than the first section, and a third section coupled to the second section and doubling back on the first section.

16. The electronic device of claim 15, wherein the first section and second section are substantially perpendicular to one another, and the first section and third section are substantially parallel to one another.

17. The electronic device of claim 11, wherein one of the first length or the second length may be modified without modifying the other of the second length or the first length.

18. The electronic device of claim 17, wherein a thickness of at least a portion of the conductive segment is adjusted to modify the one of the first length or the second length without modifying the other of the second length or the first length.

19. The electronic device of claim 11, wherein the conductive segment is a first conductive segment, and further wherein the multi-band antenna includes a second conductive segment, wherein the second conductive segment includes:

a third resonant portion having a third length defined by an outer perimeter of the second conductive segment and operable to effect an antenna for communication in a third band of frequencies; and a fourth resonant portion having a fourth length defined by an inner perimeter of the second conductive segment and operable to resonate capacitively for communication in a fourth different band of frequencies.

20. The electronic device of claim 11, wherein the multi-band antenna further includes a separate conductive segment, the separate conductive segment positioned proximate the conductive segment, such that a capacitive coupling between the separate conductive segment and the conductive segment provides an effective length of the conductive segment greater than an actual length of the conductive segment.

* * * * *